US008947006B2

(12) United States Patent
Gou

(10) Patent No.: US 8,947,006 B2
(45) Date of Patent: Feb. 3, 2015

(54) MULTI-MODE CONTROL CIRCUIT FOR LIGHT-EMITTING SHOE

(71) Applicant: Terry Electronics (S.Z) Co., Ltd., ShenZhen, GuangDong Province (CN)

(72) Inventor: John Gou, ShenZhen (CN)

(73) Assignee: Terry Electronics (S.Z) Co., Ltd., ShenZhen, GuangDong Province (CN)

( * ) Notice: Subject to any disclaimer, the term of this patent is extended or adjusted under 35 U.S.C. 154(b) by 20 days.

(21) Appl. No.: 13/860,023

(22) Filed: Apr. 10, 2013

(65) Prior Publication Data

US 2014/0306611 A1 Oct. 16, 2014

(51) Int. Cl.

| | |
|---|---|
| ***H05B 37/00*** | (2006.01) |
| ***H05B 33/08*** | (2006.01) |
| ***F21V 33/00*** | (2006.01) |

(52) U.S. Cl.

CPC ..... *H05B 33/0854* (2013.01); *F21V 33/0008* (2013.01)

USPC ..... 315/200 A; 315/360; 315/362

(58) Field of Classification Search

USPC ..... 315/152, 200 A, 323, 360, 362; 362/103, 183, 192, 193, 205, 253, 276, 362/295, 394, 411, 570, 802

See application file for complete search history.

(56) References Cited

U.S. PATENT DOCUMENTS

| | | | | |
|---|---|---|---|---|
| 5,955,957 | A * | 9/1999 | Calabrese et al. | 340/691.8 |
| 6,104,140 | A * | 8/2000 | Wut et al. | 315/200 A |
| 6,280,045 | B1 * | 8/2001 | Anteby et al. | 362/103 |
| 6,348,766 | B1 * | 2/2002 | Ohishi et al. | 315/200 A |
| 6,789,913 | B2 * | 9/2004 | Wei | 362/103 |
| 7,207,688 | B2 * | 4/2007 | Yuen et al. | 362/103 |
| 8,087,801 | B2 * | 1/2012 | Tseng | 362/249.05 |
| 8,641,220 | B1 * | 2/2014 | Lin | 362/103 |

* cited by examiner

*Primary Examiner* — Tung X Le

(74) *Attorney, Agent, or Firm* — Garcia-Zamor IP Law; Ruy M. Garcia-Zamor

(57) ABSTRACT

A multi-mode control circuit for light-emitting shoe, comprising a control circuit, wherein the control circuit comprises a microprocessor-encapsulated circuit board and a motion actuated switch, the motion actuated switch is at least provided with two trigger circuits, the first trigger circuit can trigger the control circuit in response to the motion of a shoe body, so that light-emitting bodies light in a predetermined way, and the second trigger circuit is used for activating a circuit-predetermined control mode, the predetermined control mode is that, a power supply control switch of the circuit is activated, or the light-emitting bodies are activated to light in the $N^{th}$ predetermined way when the second trigger circuit performs the $N^{th}$ triggering, wherein N is a natural number larger than or equal to 1, and the value of N, when being equal to the total number of the predetermined ways plus 1, is reset to 1.

4 Claims, 5 Drawing Sheets

MULTI-MODE CONTROL CIRCUIT FOR LIGHT-EMITTING SHOE

TECHNICAL FIELD

The invention relates to the field of LED lighting decoration, in particular to a multi-mode control circuit for LED decorative lamps on a light-emitting shoe.

BACKGROUND

It is well known that, light-emitting shoe is a product featured by embedment of light-emitting bodies thereon, and decoration for the shoe is achieved by flashing light of multiple styles and colors emitted by the light-emitting bodies, such a pair of shoes that is capable of lighting can create a surge of walking-learning children's interest in walking and can be used as a prop for heightening festival's atmosphere and also as a device for teenagers to show their unique personalities, as a result, this kind of light-emitting shoe is extremely popular among all classes of people.

The light-emitting device arranged on the traditional light-emitting shoe is mostly composed of LED light-emitting bodies, a one-shot button cell serving as power supply, and a drive circuit, wherein a motion actuated switch is generally arranged in the drive circuit, and is triggered by movement of a user wearing the shoes, thus achieving the purpose that the drive circuit is triggered to control the LED light-emitting bodies to light.

However, the light-emitting shoe discussed above is controlled by the motion actuated switch, so the motion actuated switch will be triggered only if the user wears the shoes and then moves, which causes the LED light-emitting bodies to be always under a working state. To avoid this situation, a manual power supply switch is externally arranged in general, and the power supplied to the LED light-emitting bodies can be cut off through this manual power supply switch, therefore, meaningless consumption of the electric power in the one-shot button cell in the light-emitting device of the light-emitting shoe can be avoided when the user wears the light-emitting shoes in the daytime, and the light-emitting shoe can be used on the premise of satisfying different conditions. But it is required in this method that the user bends to operate the manual power supply switch on the shoe by hands, so the shoe control mode is not flexible enough.

SUMMARY OF THE INVENTION

The objective of the invention is to provide a multi-mode control circuit for light-emitting shoe, and the main technical problem to be solved by the invention is that: a power supply control switch needs to be individually arranged for a traditional light-emitting shoe, in order to achieve the purpose that light-emitting bodies on the shoe light as required by the user, and this way of individual switch arrangement results in high cost and inadequate flexibility in operation.

To solve the technical problem above, the technical scheme below is adopted by the invention:

The invention provides a multi-mode control circuit for light-emitting shoe, comprising:

a waterproof enclosure embedded in a shoe body, wherein the enclosure has a cavity in which a lighting control circuit can be placed;

a control circuit embedded in the cavity of the waterproof enclosure and comprising a microprocessor-encapsulated circuit board and a motion actuated switch, wherein the positive electrode of the circuit board is electrically coupled to the positive electrodes of a plurality of light-emitting bodies and the positive electrode of a power supply;

the motion actuated switch is electrically connected with the circuit board and is at least provided with two trigger circuits, the first trigger circuit is used for triggering the control circuit in response to the motion of the shoe body, so that light-emitting bodies light in a predetermined way, and the second trigger circuit is used for triggering the control circuit to activate a circuit-predetermined control mode; and a micro-current battery spot-welded on the circuit board and used for supplying the control circuit with electric power;

wherein the predetermined control mode is that, a power supply control switch of the circuit is activated, or the light-emitting bodies are activated to light in the $N^{th}$ predetermined way when the second trigger circuit performs the $N^{th}$ triggering, wherein N is a natural number larger than or equal to 1, and the value of N, when being equal to the total number of the predetermined ways plus 1 is reset to 1, or the second trigger circuit triggers the control circuit N times, N is a natural number larger than or equal to 1; when N is equal to 1, the power supply control switch of the circuit is activated to switch on the power supply, and the light-emitting bodies light in the first predetermined way; when N is larger than or equal to 2, the light emitting bodies are activated to light in the $N^{th}$ predetermined way; when the total time for the second trigger circuit to continuously trigger the control circuit three times is within 2 seconds, the power supply control switch of the circuit is activated once again to switch off the power supply, and the value of N is zeroed; when the value of N is equal to the total number of the predetermined ways plus 1, the power supply is switched off and the value of N is zeroed.

The motion actuated switch comprises a radially swingable pendulum spring, and a first contact and a second contact arranged on the swing track of the pendulum spring; the pendulum spring, the first contact and the second contact are all electrically connected to the circuit board, the pendulum spring and the first contact form the first trigger circuit, the pendulum spring and the second contact form the second trigger circuit, wherein one end of the pendulum spring is fixedly arranged while the other end is horizontally arranged in a suspended manner, the first contact is located just below the suspended end of the pendulum spring, and the second contact is located at a position the suspended end of the pendulum spring can reach during horizontal swing.

A horizontal distance between the second contact and the suspended end of the pendulum spring is larger than A vertical distance between the first contact and the suspended end of the pendulum spring.

The second contact is located at a position the suspended end of the pendulum spring can reach under the maximal amplitude of swing Compared with the prior art, the invention has the advantages that: flexible switch-on/off of the control power supply and switching of the lighting ways of the light-emitting bodies are realized by arranging at least two trigger circuits in the motion actuated switch, wherein the first trigger circuit is a common trigger circuit for enabling the light-emitting bodies to light in a predetermined way and the second trigger circuit is capable of activating the power supply switch of the control circuit and activating the predetermined lighting way of the light-emitting bodies.

DETAILED DESCRIPTION OF THE EMBODIMENTS

The multi-mode control circuit for light-emitting shoe provided by the invention will be described below in details with reference to FIG. 1 to FIG. 5 and the preferred embodiments.

Figure 4:
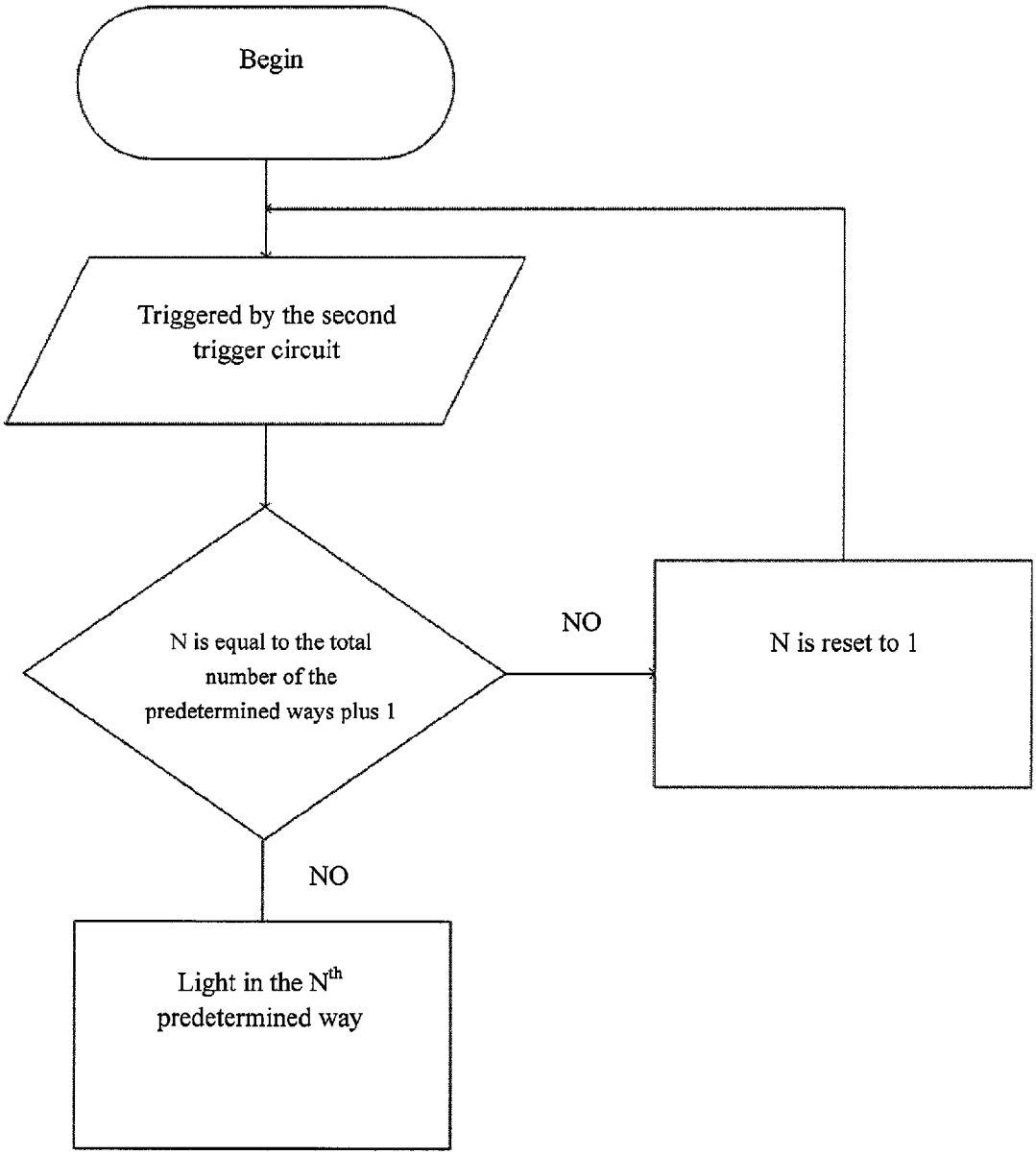
FIG. 4 is a flowchart of the embodiment 2 of the invention.

The multi-mode control circuit for light-emitting shoe provided by the invention comprises a waterproof enclosure 1 embedded in a shoe body and a control circuit embedded in the inner cavity of the waterproof enclosure 1, and the control circuit comprises a microprocessor-encapsulated circuit board 2 and a motion actuated switch 10;

The positive electrode of the circuit board 2 is electrically coupled to the positive electrodes of a plurality of light-emitting bodies 3 and the positive electrode of a power supply;

The motion actuated switch 10 is electrically connected with the circuit board 2 and at least comprises a first trigger circuit and a second trigger circuit, the first trigger circuit is used for triggering the control circuit in response to the motion of the shoe body, so that light-emitting bodies light in a predetermined way, and the second trigger circuit is used for triggering the control circuit to activate a circuit-predetermined control mode;

The multi-mode control circuit for light-emitting shoe further comprises a micro-current battery spot-welded on the circuit board 2 and used for supplying the control circuit with electric power;

Wherein the predetermined control mode is that:

Embodiment 1: a power supply control switch of the circuit is activated; when the power supply control switch is switched off, the second trigger circuit triggers the circuit-activating power supply control switch to switch on the power supply control switch; when the power supply control switch is switched on, the second trigger circuit triggers the circuit-activating power supply control switch to switch off the power supply control switch; in this embodiment, switch-on/off of the control circuit can be flexibly controlled so as to facilitate user's selection for a desired mode;

Embodiment 2: as shown in FIG. 4, the light-emitting bodies 3 are activated to light in the $N^{th}$ predetermined way when the second trigger circuit performs the $N^{th}$ triggering, wherein N is a natural number larger than or equal to 1, and the value of N, when being equal to the total number of the predetermined ways plus 1, is reset to 1; the light-emitting diodes 3 light again in the first predetermined way, thus lighting can be ceaselessly cycled as required by user.

Figure 5:
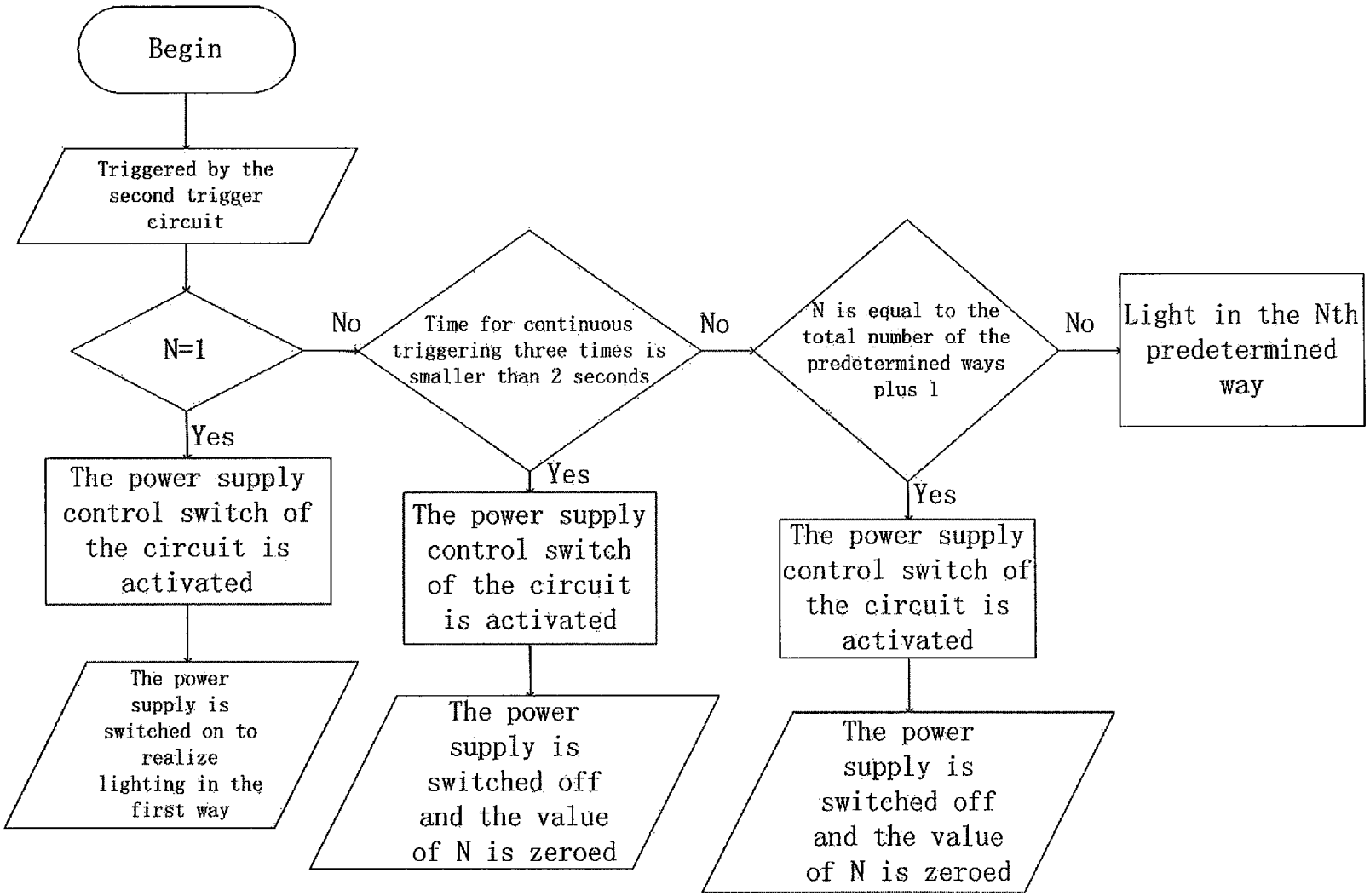
FIG. 5 is a flowchart of the embodiment 1 of the invention.

Embodiment 3: as shown in FIG. 5, the second trigger circuit triggers the control circuit N times, N is a natural number larger than or equal to 1; when N is equal to 1, the power supply control switch of the circuit is activated to switch on the power supply, and the light-emitting bodies 3 light in the first predetermined way; when N is larger than or equal to 2, the light emitting bodies 3 are activated to light in the $N^{th}$ predetermined way; when the total time for the second trigger circuit to continuously trigger the control circuit three times is within 2 seconds, the power supply control switch of the circuit is activated once again to switch off the power supply, and the value of N is zeroed; when the value of N is equal to the total number of the predetermined ways plus 1, the power supply control switch of the circuit is activated once again to switch off the power supply, and the value of N is zeroed.

The first trigger switch above is only used for enabling the plurality of light-emitting bodies 3 to light in the current way among the predetermined ways.

Figure 1:
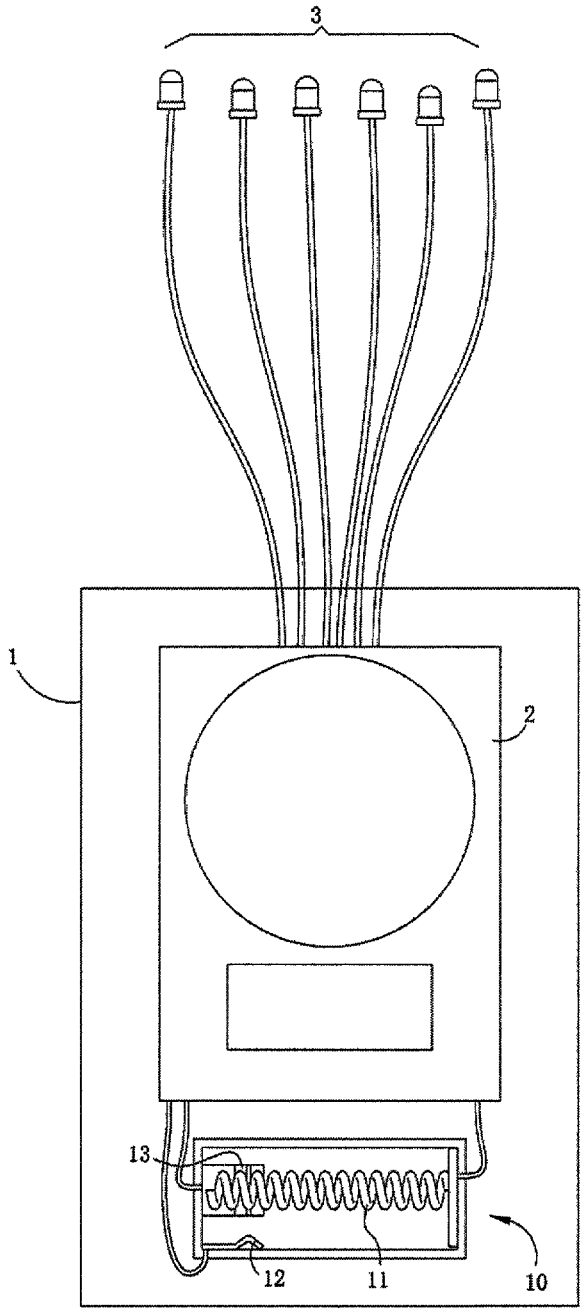
FIG. 1 is a block diagram of the invention.
Figure 2:
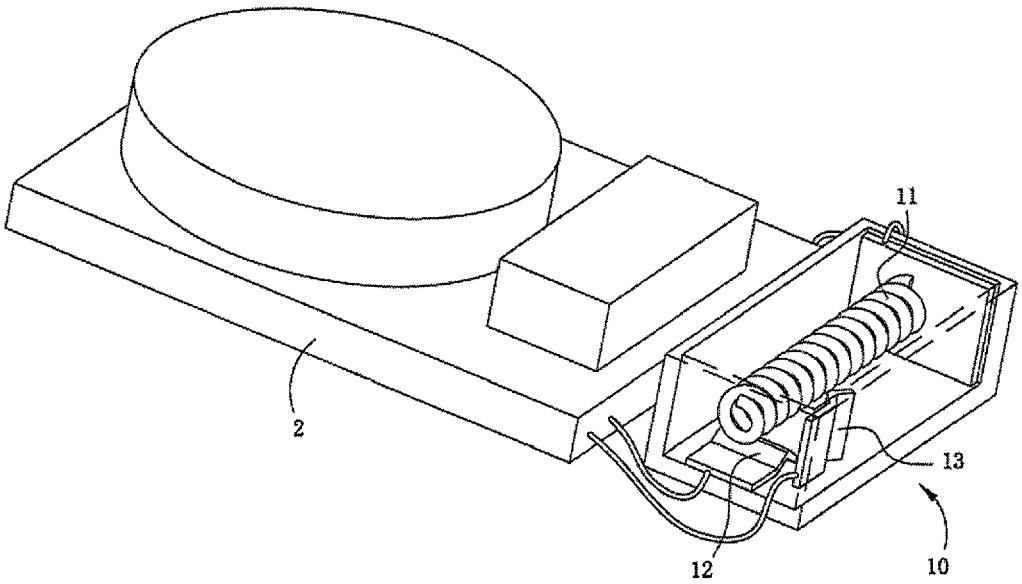
FIG. 2 is a schematic diagram of the control circuit of the invention.
Figure 3:
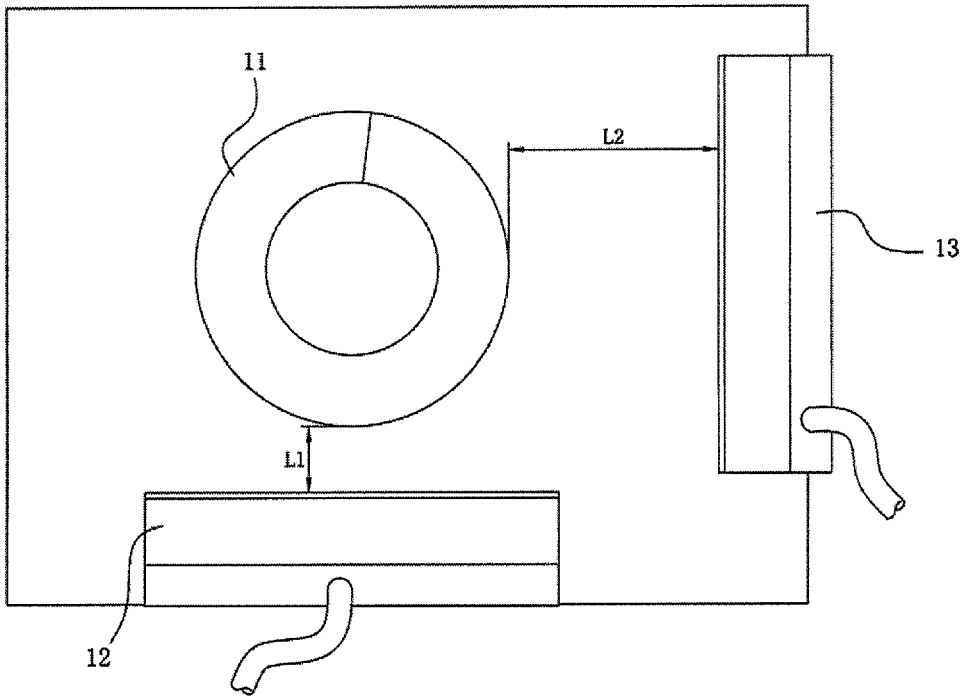
FIG. 3 is a schematic diagram of the motion actuated circuit of the invention.

As shown in FIG. 1 to FIG. 3, the motion actuated switch 10 comprises a radially swingable pendulum spring 11, and a first contact 12 and a second contact 13 arranged on the swing track of the pendulum spring 11; the pendulum spring 11, the first contact 12 and the second contact 13 are all electrically connected to the circuit board 2, the pendulum spring 11 and the first contact 12 form the first trigger circuit, the pendulum spring 11 and the second contact 13 form the second trigger circuit, wherein one end of the pendulum spring 11 is fixedly arranged while the other end is horizontally arranged in a suspended manner, the first contact 12 is located just below the suspended end of the pendulum spring 11, and the second contact 13 is located at a position the suspended end of the pendulum spring 11 can reach during horizontal swing; a light-emitting shoe adopting the multi-mode control circuit of the invention can perform a vertical motion in the process of normal walking, so that the pendulum spring 11 can come into overlapping contact with the first contact 12 to realize continuous triggering of the first trigger circuit, and when triggering of the second trigger circuit is needed, the pendulum spring 11 can swing horizontally to come into overlapping contact with the second contact 13 only by knocking the light-emitting shoe horizontally.

A horizontal distance L2 between the second contact 13 and the suspended end of the pendulum spring 11 is larger than a vertical distance L1 between the first contact 12 and the suspended end of the pendulum spring 11, in this way, the amplitude of horizontal vibration required by overlapping contact of the pendulum spring 11 with the second contact 13 is increased.

The second contact 13 is located at a position the suspended end of the pendulum spring 11 can reach under the maximal amplitude of swing, thus erroneous contact of time pendulum spring 11 with the second contact 13 can be prevented as much as possible.

The invention includes all alternative contents within the scope mentioned in the patent application scope. Any equivalent variations made within the patent application scope of the invention shall fall within the patent scope of this application.

What is claimed is:

1. A multi-mode control circuit for light-emitting shoe, comprising, a waterproof enclosure embedded in a shoe body, the enclosure having a cavity in which a lighting control circuit is configured to be placed;

a control circuit embedded in the cavity of the waterproof enclosure and comprising a microprocessor-encapsulated circuit board and a motion actuated switch, the positive electrode of the circuit board being electrically coupled to the positive electrodes of a plurality of light-emitting bodies and the positive electrode of a power supply;

the motion actuated switch being electrically connected with the circuit board and being at least provided with two trigger circuits, the first trigger circuit being used for triggering the control circuit in response to the motion of the shoe body, so that light-emitting bodies light in a predetermined way, and the second trigger circuit being used for triggering the control circuit to activate a circuit-predetermined control mode; and a micro-current battery spot-welded on the circuit board and used for supplying the control circuit with electric power, wherein the predetermined control mode is that, a power supply control switch of the circuit is activated, or the light-emitting bodies are activated to light in the $N^{th}$ predetermined way when the second trigger circuit performs the $N^{th}$ triggering, wherein N is a natural number larger than or equal to 1, and the value of N, when being equal to the total number of the predetermined ways plus 1, is reset to 1, or the second trigger circuit triggers the control circuit N times, N is a natural number larger than or equal to 1; when N is equal to 1, the power supply control switch of the circuit is activated to switch on the power supply, and the light-emitting bodies light in the first predetermined way; when N is larger than or equal to 2, the light emitting bodies are activated to light in the $N^{th}$ predetermined way; when the total time for the second trigger circuit to continuously trigger the control circuit three times is within 2 seconds, the power supply control switch of the circuit is activated once again to switch off the power supply, and the value of N is zeroed; when the value of N is equal to the total number of the predetermined ways plus 1, the power supply control switch of the circuit is activated once again to switch off the power supply and the value of N is zeroed.

2. A multi-mode control circuit for light-emitting shoe according to claim 1, wherein the motion actuated switch comprises a radially swingable pendulum spring, and a first contact and a second contact arranged on the swing track of the pendulum spring; the pendulum spring, the first contact and the second contact are all electrically connected to the circuit board, the pendulum spring and the first contact form the first trigger circuit, the pendulum spring and the second contact form the second trigger circuit, wherein one end of the pendulum spring is fixedly arranged while the other end is horizontally arranged in a suspended manner, the first contact is laved just below the suspended end of the pendulum spring, and the second contact is located at a position the suspended end of the pendulum sprig can reach during horizontal swing.

3. A multi-mode control circuit for light-emitting shoe according to claim 2, wherein a horizontal distance between the second contact and the suspended end of the pendulum spring is larger than a vertical distance between the first contact and the suspended of the pendulum sprite.

4. A multi-mode control circuit for light-emitting shoe according to claim 3, wherein the second contact is located at a position the suspended end of the pendulum spring can reach under the maximal amplitude of swing.

* * * * *